US008257192B2

(12) United States Patent
Lee

(10) Patent No.: US 8,257,192 B2
(45) Date of Patent: Sep. 4, 2012

(54) COMBINATION PUTTER AND CHIPPER GOLF CLUB

(76) Inventor: Joo-Hyung Lee, Gyeonggi-do (KR)

( * ) Notice: Subject to any disclaimer, the term of this patent is extended or adjusted under 35 U.S.C. 154(b) by 112 days.

(21) Appl. No.: 12/853,293

(22) Filed: Aug. 10, 2010

(65) Prior Publication Data

US 2011/0034267 A1 Feb. 10, 2011

(30) Foreign Application Priority Data

Aug. 10, 2009 (KR) ..... 10-2009-0073238

(51) Int. Cl.
*A63B 69/36* (2006.01)
*A63B 53/04* (2006.01)

(52) U.S. Cl. ..... 473/248; 473/307; 473/325; 473/340

(58) Field of Classification Search ..... 473/244–251, 473/325, 340, 305–315
See application file for complete search history.

(56) References Cited

U.S. PATENT DOCUMENTS

| | | | | |
|---|---|---|---|---|
| 2,336,405 | A * | 12/1943 | Kent | 473/245 |
| 2,661,952 | A * | 12/1953 | Jackson | 473/248 |
| 3,595,582 | A * | 7/1971 | Chapman | 473/244 |
| 4,174,108 | A * | 11/1979 | Reinholz | 473/247 |
| 4,506,888 | A * | 3/1985 | Nardozzi, Jr. | 473/307 |
| 4,778,180 | A * | 10/1988 | Guenther | 473/248 |
| 5,458,335 | A * | 10/1995 | Hattori | 473/325 |
| 6,428,423 | B1 * | 8/2002 | Merko | 473/307 |
| 6,979,269 | B1 | 12/2005 | Nohara | |
| 7,083,529 | B2 * | 8/2006 | Cackett et al. | 473/309 |
| 7,374,500 | B2 * | 5/2008 | Engdahl | 473/340 |
| 2003/0060301 | A1 * | 3/2003 | Hsu | 473/248 |

FOREIGN PATENT DOCUMENTS

| | | |
|---|---|---|
| KR | 20-0429945 | 10/2006 |
| KR | 10-0955871 | 4/2010 |

* cited by examiner

*Primary Examiner* — Sebastiano Passaniti
(74) *Attorney, Agent, or Firm* — Rabin & Berdo, PC

(57) ABSTRACT

Disclosed herein is a combination putter and chipper golf club. The golf club is constructed such that opposite side surfaces of the club head can be used, respectively, as a putter and a chipper, and the club head is easily switched between a putter and a chipper when the golf club is used, and the club head is prevented from shaking when putting or chipping. The golf club has a shaft and a head. A putter face and a chipper face are provided, respectively, on opposite side surfaces of the head. A coupling frame is provided between the shaft and the head.

7 Claims, 7 Drawing Sheets

COMBINATION PUTTER AND CHIPPER GOLF CLUB

BACKGROUND OF THE INVENTION

1. Cross-Reference to Related Application

This application claims priority of Korean Patent Application No. 10-2009-0073238, filed Aug. 10, 2009, the disclosure of which is expressly incorporated by reference herein in its entirety.

2. Field of the Invention

The present invention relates generally to a combination putter and chipper golf club and, more particularly, to a combination putter and chipper golf club, which is constructed such that opposite side surfaces of the club head can be used, respectively, as a putter and a chipper, and the club head is easily switched between a putter and a chipper when the golf club is used, and the club head is prevented from shaking when putting or chipping.

3. Description of the Related Art

Generally, golf is a game which is played on a wide course by successively striking a small ball into a series of holes with various kinds of clubs. The aim of golf is to complete the course using as few strokes as possible. Recently, as the standard of living is becoming elevated, the number of people who enjoy golfing has increased.

In golf, unless a hole in one is made after a shot with an iron or a driver has been made on the course, a putter or a chipper is used to hit a ball into a hole from a position near the hole. Here, if the ball is placed on the green, the putter is used. Or, if the ball is placed around the green, the ball is hit to a position near the hole using the chipper. In this case, unless the ball is put in the hole, the ball is put in the hole using the putter again.

Conventionally, a putter for use on or around the green and a chipper which is used for a chip shot are provided separately, and so golfers must separately purchase the putter and the chipper.

In order to solve the problem, Korean U.M. Registration No. 20-0429945 disclosed a combination putter and chipper golf club. As shown in FIG. 1, the golf club is constructed so that a head 10 is coupled to a neck 7 provided on the lower portion of a shaft 3 over which a grip 5 is fitted. The head 10 is characterized in that a putter face 12 is formed on one side surface thereof, and a chipper face 14 having a loft angle is formed on the other side surface.

Such a golf club is advantageous in that the head 10 is rotatable, so that opposite side surfaces of the head 10 can be used, respectively, as a putter and a chipper. However, the golf club is problematic in that the constraining force of the head 10 is weak, so that the head 10 may undesirably rotate when a golfer conducts an approach using the chipper face 14, and thus it is difficult to achieve a precise shot.

Further, the golf club is problematic in that there is no reference point to use when rotating the head 10, so that it is difficult to precisely align the putter face 12 or the chipper face 14 to be perpendicular to the direction of the desired target, and thus a ball may fly in a direction different from that intended by the golfer.

SUMMARY OF THE INVENTION

Accordingly, the present invention has been made keeping in mind the above problems occurring in the prior art, and an object of the present invention is to provide a combination putter and chipper golf club, which allows both putting and an approach to be performed using a single club, and enables a precise shot to be achieved without the head shaking.

Another object of the present invention is to provide a combination putter and chipper golf club, which is constructed so that a club head is rotatable and is reliably fixed at a predetermined position after the club head is rotated, thus enabling a golfer to precisely hit a golf ball in the desired direction.

In order to accomplish the above objects, the present invention provides a combination putter and chipper golf club having a shaft and a head. The golf club includes a putter face and a chipper face which are provided, respectively, on opposite side surfaces of the head, and a coupling frame provided between the shaft and the head.

A through hole may be formed vertically through a central portion of the head, and a fastening and rotating means may be installed in the through hole to rotatably couple the head to the coupling frame.

The fastening and rotating means may include a fastening member inserted into the through hole to couple the head with the coupling frame, and an elastic spring provided between the fastening member and the through hole.

Further, a coupling hole may be formed in an upper end of the through hole so that the coupling frame is inserted into the coupling hole to be coupled thereto, and first and second enlarged cavities may be formed, respectively, on a lower end of the through hole and a portion under the coupling hole such that the elastic spring is seated in either of the first and second enlarged cavities.

The fastening member may comprise a bolt, and the elastic spring may be provided in the first enlarged cavity.

The fastening member may comprise a handle bolt, and the elastic spring may be provided in the second enlarged cavity.

Further, a fastening hole may be formed in a central portion of the coupling frame, the fastening member may comprise a handle bolt which is fastened from a position above the fastening hole through the through hole of the head, and the elastic spring may be provided in the second enlarged cavity, with a nut being fastened to a lower end of the handle bolt.

Further, an elastic member may be interposed between the coupling frame and the head.

The coupling frame may include a body, a shaft coupler provided on an upper portion of the body, a head coupler protruding from a lower portion of the body, and a positioning protrusion provided on each of opposite ends of the body in a longitudinal direction thereof.

A positioning hole may be formed in an upper portion of the head in such a way as to be located at a position corresponding to that of the positioning protrusion.

As is apparent from the above description, a combination putter and chipper golf club according to the present invention is advantageous in that a putter face and a chipper face are provided, respectively, on opposite side surfaces of a head, and the head is rotatable, thus allowing both putting and an approach to be performed using a single club.

Further, a combination putter and chipper golf club according to the present invention is advantageous in that a head is firmly coupled to a coupling frame, thus allowing a user to make a precise shot without the head shaking in the case of putting or doing a chip shot, and the head can be reliably fixed at a precise position after it rotates, thus enabling a golfer to precisely hit a ball in the desired direction.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, combination putter and chipper golf clubs according to the preferred embodiments of the present invention will be described in detail with reference to the accompanying drawings.

Figure 1:
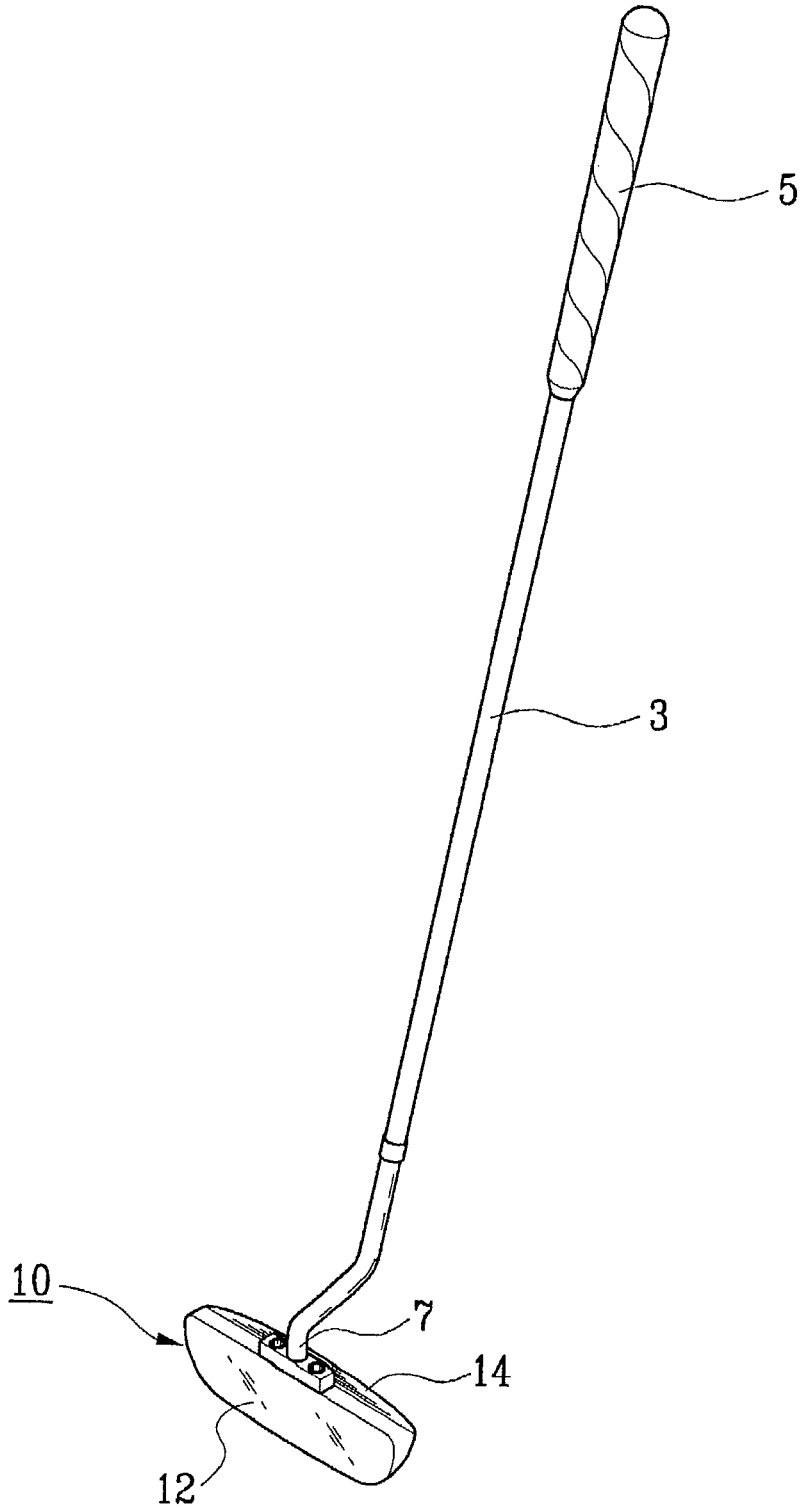
FIG. 1 is a perspective view illustrating a conventional combination putter and chipper golf club.
Figure 2:
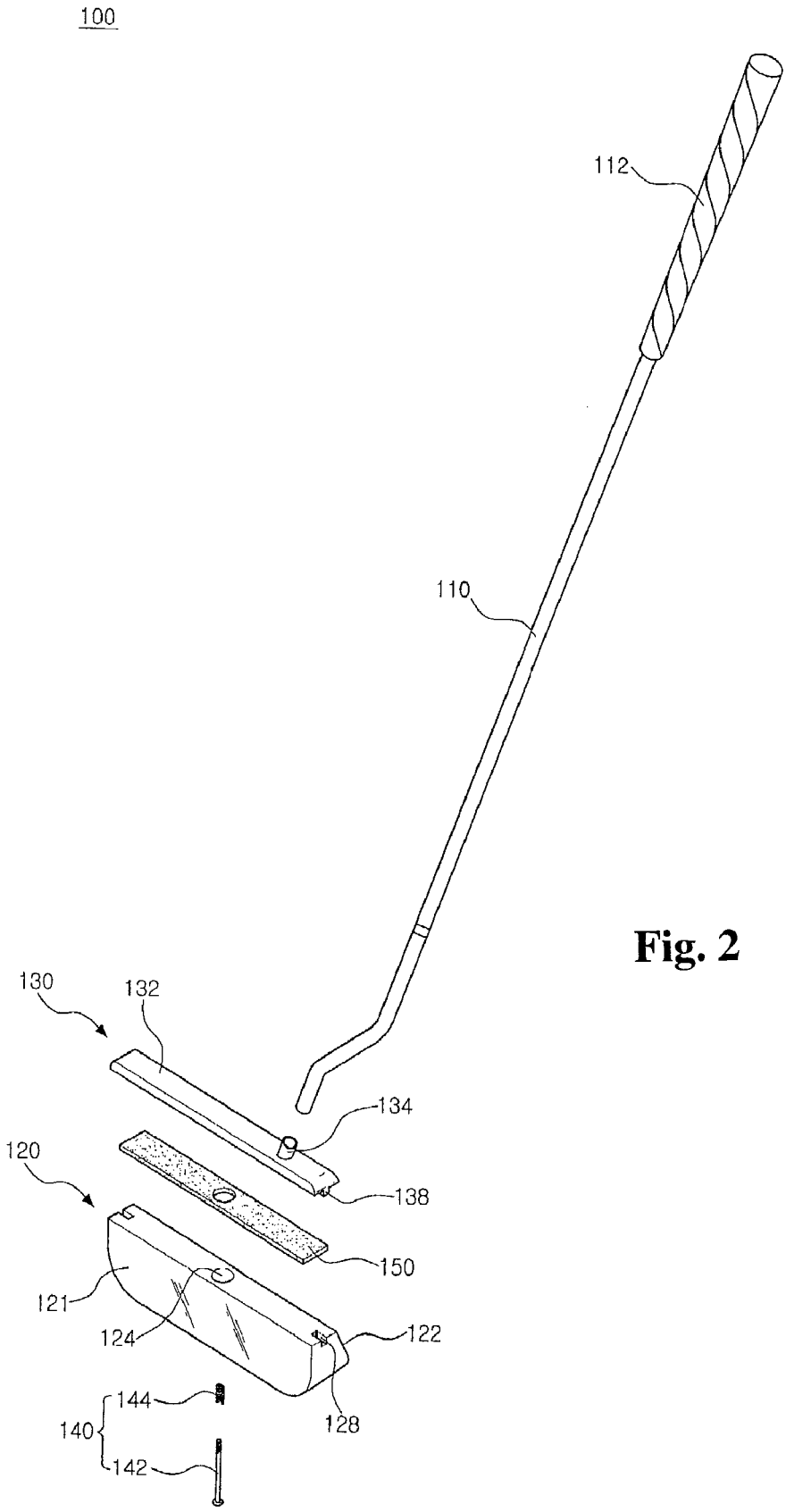
FIG. 2 is an exploded perspective view illustrating a combination putter and chipper golf club, according to an embodiment of the present invention.
Figure 3A:
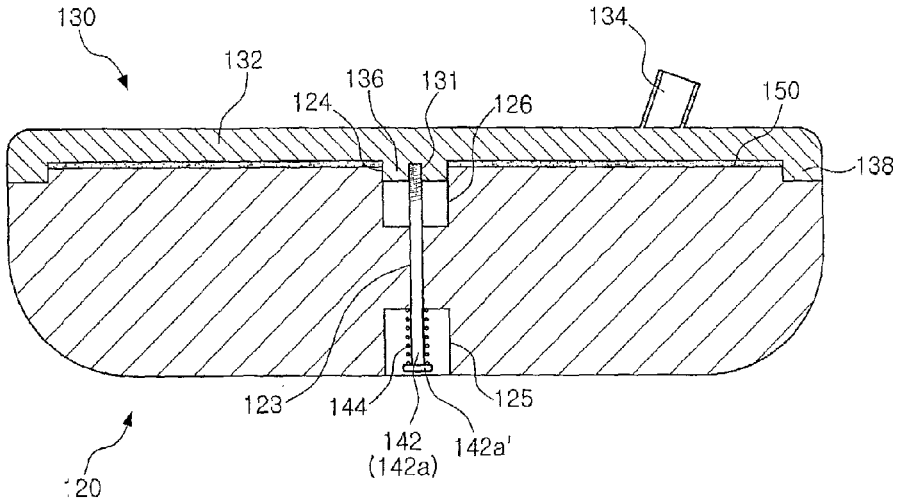
FIGS. 3A and 3B are front views illustrating important parts of the present invention shown in FIG. 2.
Figure 3B:
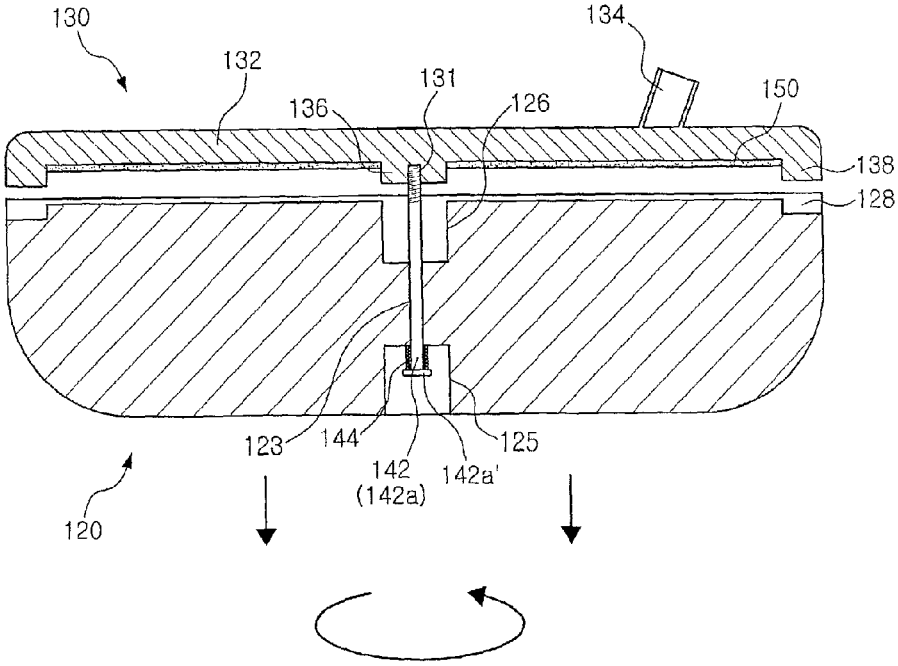
Figure 4:
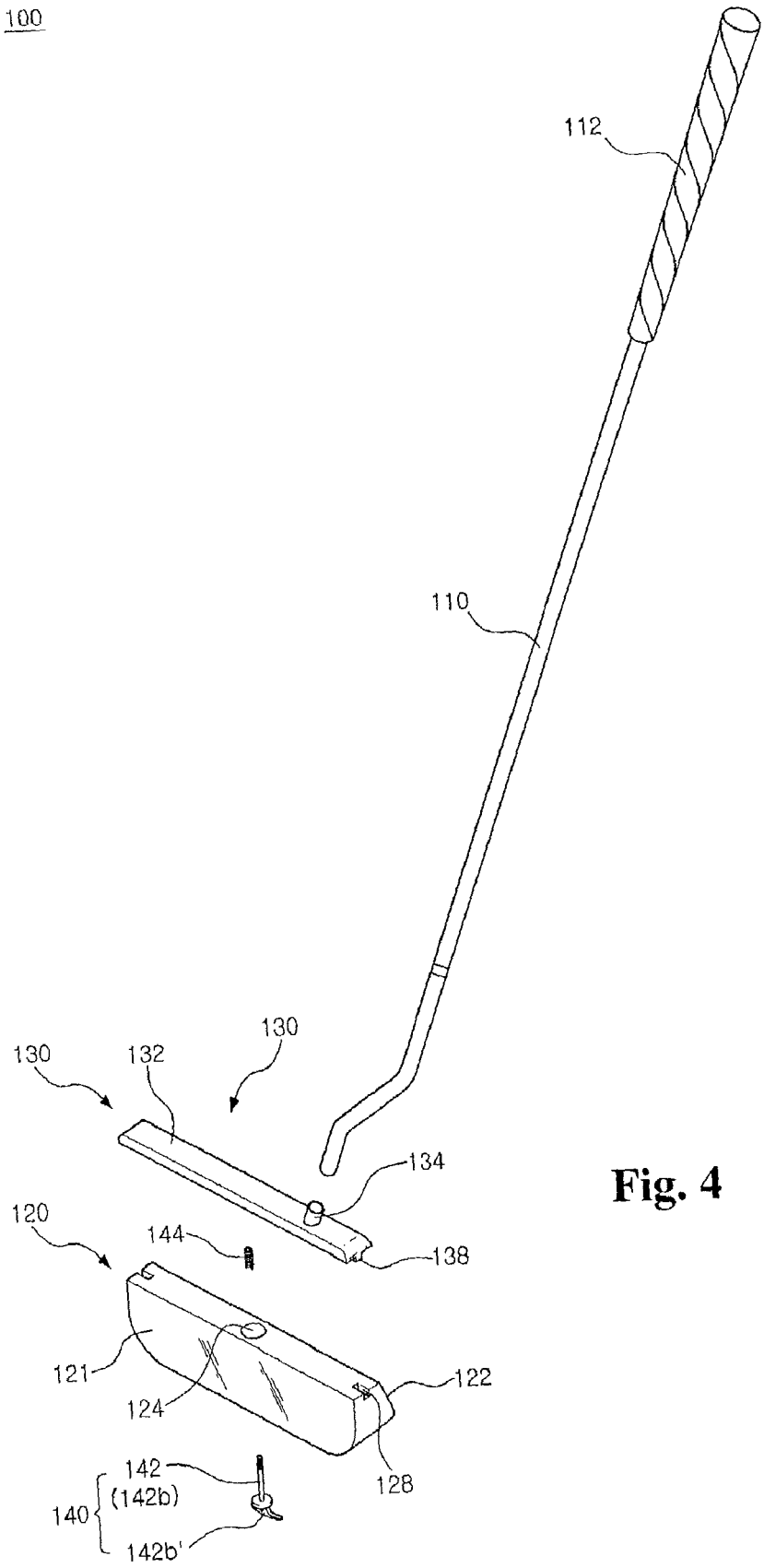
FIG. 4 is an exploded perspective view illustrating a combination putter and chipper golf club, according to another embodiment of the present invention.
Figure 5A:
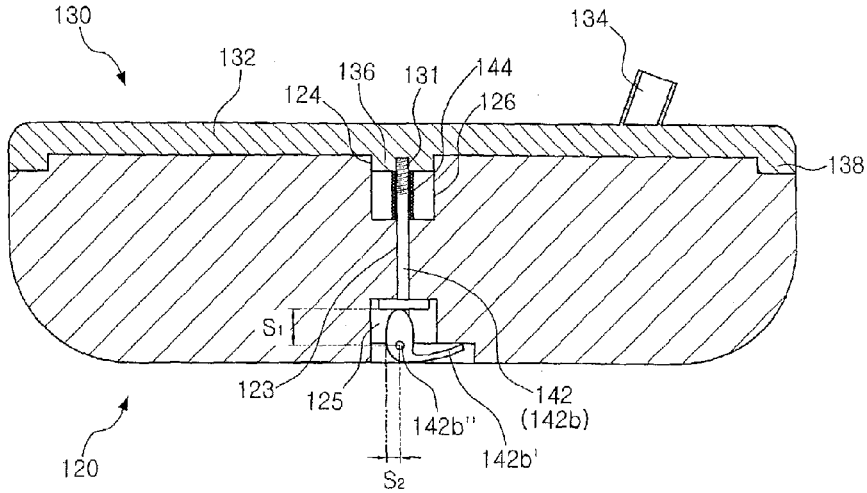
FIGS. 5A and 5B are front views illustrating important parts of the present invention shown in FIG. 4.
Figure 5B:
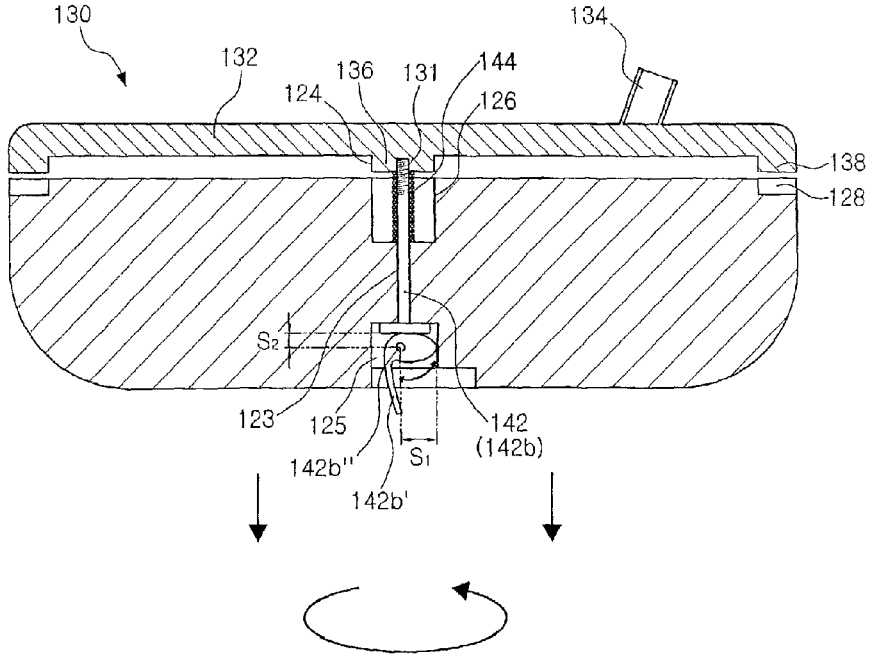
Figure 6:
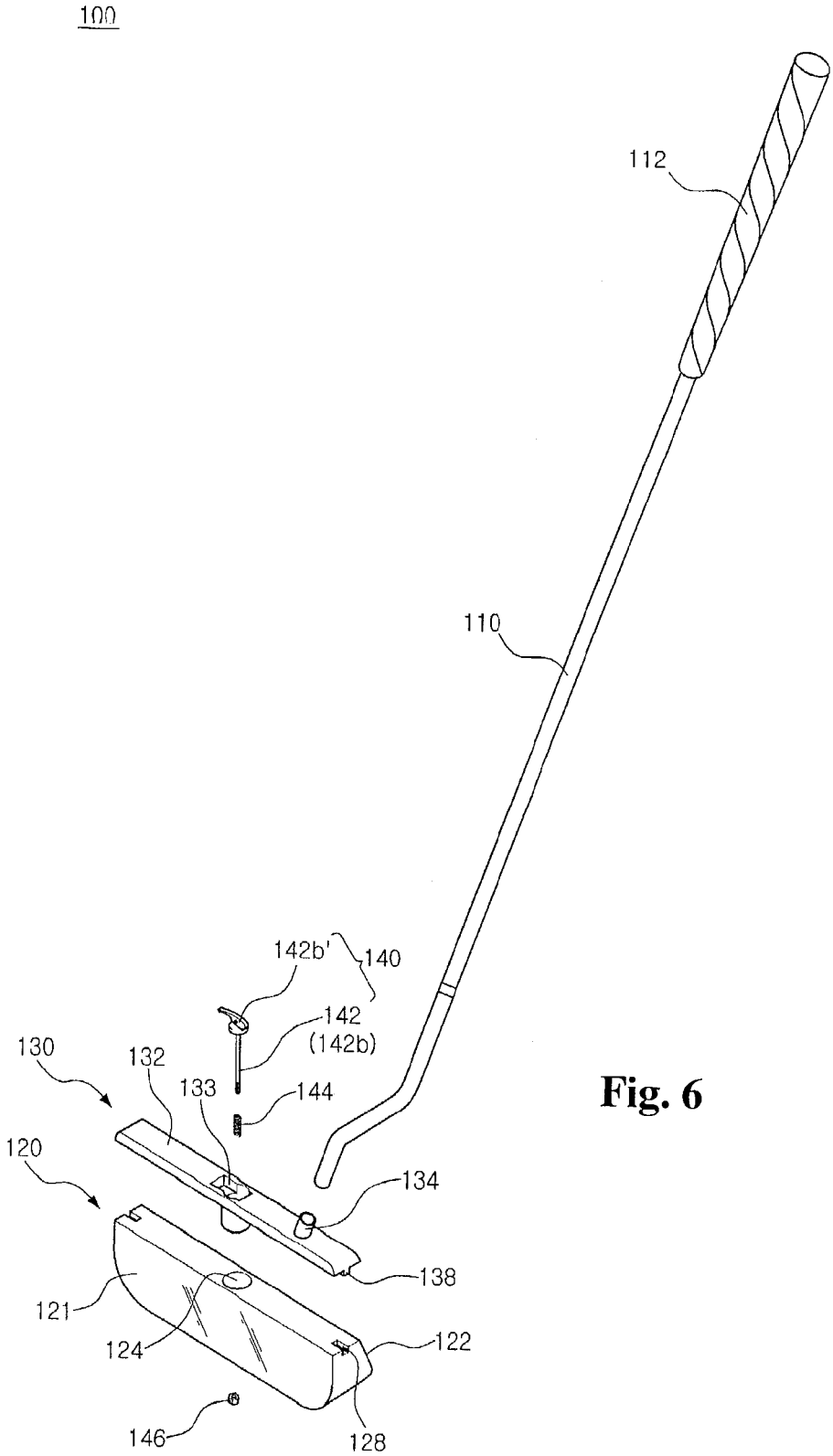
FIG. 6 is an exploded perspective view illustrating a combination putter and chipper golf club, according to a further embodiment of the present invention.
Figure 7A:
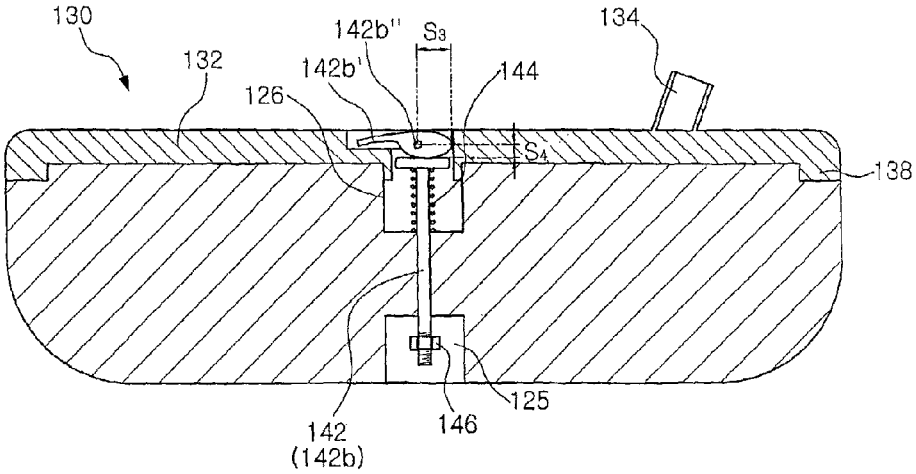
FIGS. 7A and 7B are front views illustrating important parts of the present invention shown in FIG. 6.
Figure 7B:
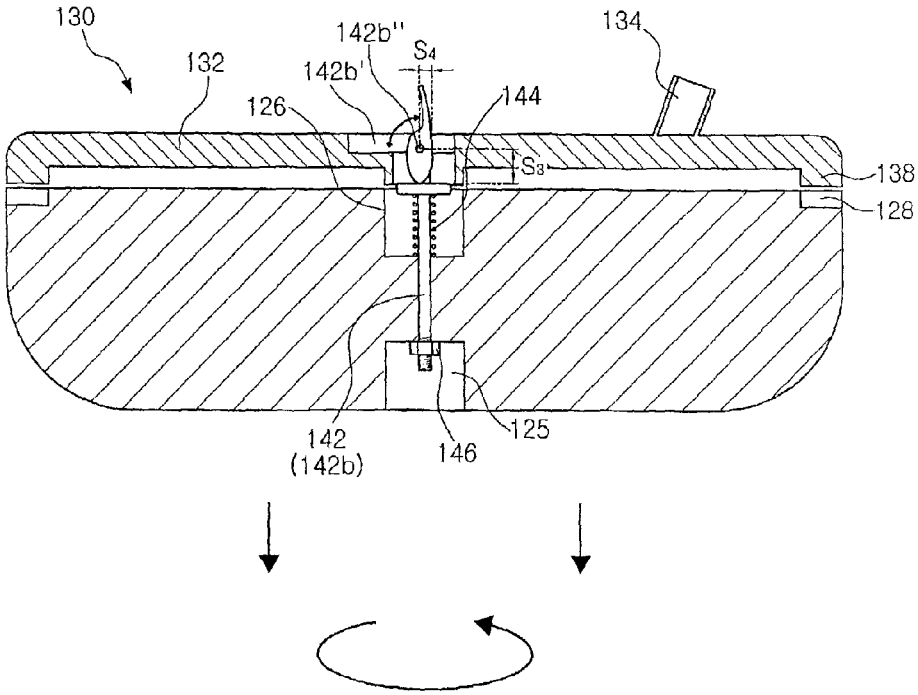

FIG. 2 is an exploded perspective view illustrating a combination putter and chipper golf club, according to an embodiment of the present invention, FIGS. 3A and 3B are front views illustrating important parts of the present invention shown in FIG. 2, FIG. 4 is an exploded perspective view illustrating a combination putter and chipper golf club, according to another embodiment of the present invention, FIGS. 5A and 5B are front views illustrating important parts of the present invention shown in FIG. 4, FIG. 6 is an exploded perspective view illustrating a combination putter and chipper golf club, according to a further embodiment of the present invention, and FIGS. 7A and 7B are front views illustrating important parts of the present invention shown in FIG. 6.

The present invention pertains to a combination putter and chipper golf club 100, which is constructed such that opposite side surfaces of the club head 120 can be used, respectively, as a putter and a chipper, and the club head 120 is easily switched between a putter and a chipper when the golf club 100 is used, and the club head 120 is prevented from shaking when putting or chipping. The combination putter and chipper golf club 100 mainly includes a shaft 110, a head 120 and a coupling frame 130.

In detail, the shaft 110 is a handle portion of the golf club 100, and a grip 112 is provided on the upper end of the shaft 110 such that a user can hold the grip 112 using his or her hands.

The head 120 is coupled to the lower end of the shaft 110 and is used to hit a golf ball. A putter face 121 is provided on one side surface of the head 120 and used to thrust the ball which is on the green into a hole, while a chipper face 122 having a predetermined loft angle is provided on the other side surface of the head 120 and used to propel the ball from a position around the green to a position near the hole.

That is, the putter face 121 used for putting and the chipper face 122 used for a chip shot are formed, respectively on the opposite side surfaces of the head 120, so that a user can use a single club 100 as both the putter and the chipper by rotating the head 120 as necessary.

Further, the coupling frame 130 is provided between the shaft 110 and the head 120. The coupling frame 130 serves to rotatably couple the head 120 to the shaft 110 and firmly maintain the head 120 at a predetermined position after it rotates.

Here, a through hole 123 is formed in the central portion of the head 120 in such a way as to pass vertically through the head 120. A fastening and rotating means 140 is inserted into the through hole 123 to couple the head 120 to the coupling frame 130. The fastening and rotating means 140 includes a fastening member 142 and an elastic spring 144. That is, as shown in FIG. 2, when the fastening member 142 is inserted into the through hole 130 which is formed in the central portion of the head 120, an end of the fastening member 142 is fastened to a fastening hole 131 which is formed in the lower portion of the coupling frame 130 in such a way as to correspond to the through hole 123, so that the head 120 is coupled to the coupling frame 130. The elastic spring 144 is provided between the fastening member 142 and the through hole 123, and allows a user to pull the head 120 outwards from the coupling frame 130 and then rotate the head 120.

Further, a coupling hole 124 is formed in the upper end of the through hole 123 so that the coupling frame 130 is inserted into the coupling hole 124 to be coupled thereto. First and second enlarged cavities 125 and 126 are formed, respectively, in the lower end of the through hole 123 and under the coupling hole 124. The first and second enlarged cavities 125 and 126 form a space in which the elastic spring 140 of the fastening and rotating means 140 is seated, and will be described in detail with reference to the following embodiment.

The coupling frame 130 includes a body 132, a shaft coupler 134, a head coupler 136, and positioning protrusions 138. The body 132 is constructed so that its lower surface is in contact with the upper surface of the head 120, thus supporting the head 120. The shaft coupler 134 protrudes upwards from the body 132 to allow the shaft 110 to be coupled to the coupling frame 130. The shaft coupler 134 may be hollow, so that the shaft 110 is inserted into the shaft coupler 134 to be coupled thereto. Alternatively, the shaft coupler 134 may be made of the same material as the shaft 110, so that the shaft 110 is coupled to the shaft coupler 134 by adhering or welding.

Further, the head coupler 136 protrudes from the center of the lower portion of the body 132 to be inserted into the coupling hole 124 which is formed in the upper portion of the head 120, thus increasing a coupling force between the head 120 and the coupling frame 130, and holding the head 120 so that it is not shaken leftwards or rightwards when the ball is hit using either of the putter face 121 or the chipper face 122.

Further, the positioning protrusions 138 are provided on the opposite ends of the body 132 in the longitudinal direction thereof in such a way as to protrude downwards, and are inserted into positioning holes 128 which are formed in the upper portion of the head 120, thus increasing the force used to hold and prevent the head 120 from shaking leftwards or rightwards when the ball is hit using the putter face 121 or the chipper face 122. Further, when a user rotates the head 120 to use it as the putter or the chipper, the above-mentioned construction allows the rotated head 120 to be coupled at a predetermined position to the coupling frame 130. Thereby, the ball can be precisely propelled in the desired direction.

Meanwhile, as shown in FIGS. 3A and 3B, an elastic member 150 may be interposed between the lower surface of the coupling frame 130 and the upper surface of the head 120. The elastic member 150 prevents the coupling frame 130 and the head 120 from becoming worn because of friction generated between the coupling frame 130 and the head 120 when they are repeatedly separated from and coupled to each other, in addition to increasing the coupling and sealing forces between the head 120 and the coupling frame 130.

Hereinafter, in the combination putter and chipper golf club 100 according to the present invention constructed as described above, various embodiments of rotatably coupling the head 120 to the coupling frame 130 via the fastening and rotating means 140 will be described in detail with reference to the accompanying drawings.

First, according to the first embodiment, as shown in FIG. 2, the fastening member 142 and the elastic spring 144 constituting the fastening and rotating means 140 are inserted from a position below the head 120 into the first enlarged cavity 125. Here, the fastening member 142 uses a general bolt 142*a* having a head part 142*a'*.

That is, at normal times or in the case of using the golf club 100 as the putter or the chipper, as shown in FIG. 3A, the bolt 142*a* is inserted from a position below the head 120 through the through hole 123 into the fastening hole 131 which is formed in the lower portion of the coupling frame 130, so that the head 120 is coupled to the coupling frame 130. At this time, the head part 142*a*' of the bolt 142*a* is positioned in the first enlarged cavity 125 formed in the lower portion of the through hole 123, and the elastic spring 144 is inserted between the upper end of the first enlarged cavity 125 and the head part 142*a*' of the bolt 142*a*.

Further, the head coupler 136 and the positioning protrusions 138 which protrude downwards from the body 132 of the coupling frame 130 are inserted, respectively, into the coupling hole 124 and the positioning holes 128 which are formed in the upper portion of the head 120, so that a coupling force between the head 120 and the coupling frame 130 is increased and the head 120 is fixed so as not to rotate leftwards or rightwards. (In the following embodiments, when the head 120 is coupled to the coupling frame 130, the head coupler 136 and the positioning protrusions 138 are also inserted, respectively, into the coupling hole 124 and the positioning holes 128, and the detailed description thereof will be omitted.)

Meanwhile, in order to change the golf club 100 from the putter to the chipper and vice versa, the head 120 coupled to the coupling frame 130 must be rotated 180 degrees. At this time, the head 120 is pulled out from the coupling frame 130 so that the head coupler 136 and the positioning protrusions 138 are removed, respectively, from the coupling hole 124 and the positioning holes 128, and thereafter, the head 120 is rotated.

That is, as shown in FIG. 3B, when the head 120 is pulled out from the coupling frame 130, the elastic spring 144 inserted between the upper end of the first enlarged cavity 125 and the head part 142*a*' of the bolt 142*a* is compressed, so that the head 120 is separated, and thus the head coupler 136 and the positioning protrusions 138 of the coupling frame 130 are removed, respectively, from the coupling hole 124 and the positioning holes 128 which are formed in the upper end of the head 120. In this state, the head 120 is rotatable. As such, when the head 120 is pulled, rotated 180 degrees and then released, the head 120 is automatically moved and coupled to the coupling frame 130 by the elasticity of the elastic spring 144.

At this time, the head coupler 136 and the positioning protrusions 138 of the coupling frame 130 are coupled, respectively, to the coupling hole 124 and the positioning holes 128 which are formed in the upper portion of the head 120. Thus, even after the head 120 is rotated, the head 120 is coupled to a predetermined position of the coupling frame 130.

According to the second embodiment wherein the head 120 is rotatably coupled to the coupling frame 130 by the fastening and rotating means 140, the fastening member 142 included in the fastening and rotating means 140 is inserted from a position below the head 120 into the through hole 123, similarly to the above-mentioned embodiment. Further, the elastic spring 144 is inserted into the second enlarged cavity 126 through the coupling hole 124 formed in the upper portion of the head 120. Here, the fastening member 142 uses a handle bolt 142*b* which has a handle 142*b*' on the upper end of the bolt 142*b*.

That is, at normal times or in the case of using the golf club 100 as the putter or chipper, as shown in FIG. 5A, the handle bolt 142*b* is inserted from a position below the head 120 through the through hole 123 into the fastening hole 131 formed in the lower portion of the coupling frame 130, so that the head 120 is coupled to the coupling frame 130.

The handle 142*b*' of the handle bolt 142*b* is positioned in the first enlarged cavity 125 which is formed in the lower portion of the through hole 123, and the elastic spring 144 is provided between the lower end of the second enlarged cavity 126 and the head coupler 136 of the coupling frame 130 while being compressed. The handle 142*b*' of the handle bolt 142*b* is formed such that the distance s1 between the central shaft 142*b*" and the upper end is greater than the distance s2 between the central shaft 142*b*" and the left end.

Meanwhile, in order to change the golf club 100 from the putter to the chipper and vice versa, the head 120 coupled to the coupling frame 130 must be rotated 180 degrees. In this case, as shown in FIG. 5B, if the handle 142*b*' of the handle bolt 142*b* is rotated outwards relative to the head 120, namely, clockwise, the head 120 is pushed outwards from the coupling frame 130 by a difference between the distances s1 and s2 and the elastic force of the elastic spring 144 positioned in the second enlarged cavity 126. Here, the distance s1 is the distance between the central shaft 142*b*" and the upper end of the handle bolt 142*b*, and the distance s2 is the distance between the central shaft 142*b*" and the left end. When the head 120 is pushed outwards from the coupling frame 130, the head coupler 136 and the positioning protrusions 138 of the coupling frame 130 are removed, respectively, from the coupling hole 124 and the positioning holes 128 of the head 120, so that the head 120 is rotatable.

As such, in the state in which the head 120 is pushed outwards from the coupling frame 130, the head 120 is rotated 180 degrees. Thereafter, if the handle 142*b*' of the handle bolt 142*b* rotates counterclockwise, the elastic spring 144 is compressed by the difference between the distances s1 and s2, the distance s1 being the distance between the central shaft 142*b*" and the upper end of the handle bolt 142*b*, and the distance s2 being the distance between the central shaft 142*b*" and the left end. Simultaneously, the head 120 is moved towards the coupling frame 130 to be coupled thereto.

According to the third embodiment wherein the head 120 is rotatably coupled to the coupling frame 130 by the fastening and rotating means 140, the fastening member 142 included in the fastening and rotating means 140 is inserted from a position above the coupling frame 130 into the through hole 123 of the head 120, and the elastic spring 144 is inserted through the coupling hole 124 formed in the upper portion of the head 120 into the second enlarged cavity 126. Here, the fastening member 142 uses the handle bolt 142*b* which has the handle 142*b*' on the upper end of the bolt 142*b*, and a nut 146 is coupled to the lower end of the handle bolt 142*b* to fasten the handle bolt 142*b* and is positioned in the first enlarged cavity 125.

In detail, as shown in FIG. 6, a handle seating hole 133 is formed in the upper portion of the coupling frame 130 so that the handle 142*b*' of the handle bolt 142*b* is seated in the handle seating hole 133, and is formed such that the lower end of the handle seating hole 133 communicates with the fastening hole 131 formed in the lower portion of the coupling frame 130. Thereby, as shown in FIG. 7A, at normal times or when the golf club 100 is used as the putter or chipper, the handle bolt 142*b* is inserted from a position above the coupling frame 130, so that the head 120 is coupled to the coupling frame 130.

At this time, the handle 142*b*' of the handle bolt 142*b* is positioned in the handle seating hole 133 which is formed in the upper portion of the coupling frame 130, and the elastic spring 144 is normally positioned between the lower end of the second enlarged cavity 126 and the head coupler 136 of the coupling frame 130. Further, the handle 142*b*' of the handle bolt 142*b* is formed such that a distance s3 between the central shaft 142*b*" and the right end is greater than a distance s4 between the central shaft 142*b*" and the lower end.

Meanwhile, in order to change the golf club 100 from the putter to the chipper and vice versa, the head 120 coupled to the coupling frame 130 must be rotated 180 degrees. In this case, as shown in FIG. 7B, if the handle 142*b*' of the handle bolt 142*b* is rotated outwards relative to the coupling frame 130, namely, clockwise, the head 120 is pushed outwards from the coupling frame 130 while compressing the elastic spring 144 by a difference between the distances s3 and s4. Here, the distance s3 is the distance between the central shaft 142*b*" and the right end of the handle bolt 142*b*, and the distance s4 is the distance between the central shaft 142*b*" and the lower end. The head coupler 136 and the positioning protrusions 138 of the coupling frame 130 are removed, respectively, from the coupling hole 124 and the positioning holes 128 of the head 120, so that the head 120 is rotatable.

As such, in the state in which the head 120 is pushed outwards from the coupling frame 130, the head 120 is rotated 180 degrees, and thereafter the handle 142*b*' of the handle bolt 142*b* is rotated counterclockwise. At this time, the head 120 is moved towards the coupling frame 130 to be coupled thereto by an elastic force of the elastic spring 144 positioned in the second enlarged cavity 126 and a difference between the distances s3 and s4, the distance s3 being the distance between the central shaft 142*b*" and the right end of the handle bolt 142*b*, and the distance s4 being the distance between the central shaft 142*b*" and the lower end.

Thus, the combination putter and chipper golf club 100 according to the present invention is constructed so that the putter face 121 and the chipper face 122 are provided, respectively, on opposite side surfaces of the head 120, and the head 120 is rotatable, thus allowing both putting and an approach to be performed using a single club. Further, the head 120 is firmly coupled to the coupling frame 130, thus allowing a user to make a precise shot without the head shaking in the case of putting or doing a chip shot, and the head 120 can be reliably fixed at a precise position after it rotates, thus enabling a golfer to precisely hit a ball in the desired direction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, the present invention provides a combination putter and chipper golf club, which is constructed such that opposite side surfaces of the club head can be used, respectively, as a putter and a chipper, and the club head is easily switched between a putter and a chipper when the golf club is used, and the club head is prevented from shaking when putting or chipping.

What is claimed is:

1. A combination putter and chipper golf club having a shaft and a head, the golf club comprising:
- a putter face and a chipper face provided, respectively, on opposite side surfaces of the head; and
- a coupling frame provided between the shaft and the head,
- wherein a through hole is formed vertically through a central portion of the head, with fastening and rotating means being installed in the through hole to rotatably couple the head to the coupling frame;
- wherein the fastening and rotating means comprises:
  - a fastening member inserted into the through hole to couple the head with the coupling frame; and
  - an elastic spring provided between the fastening member and the through hole, and
- wherein a coupling hole is formed in an upper end of the through hole so that the coupling frame is inserted into the coupling hole to be coupled thereto, and first and second enlarged cavities are formed, respectively, on a lower end of the through hole and a portion under the coupling hole such that the elastic spring is seated in either of the first and second enlarged cavities.

2. The combination putter and chipper golf club as set forth in claim 1, wherein the fastening member comprises a bolt which is fastened upwards from below the head, and the elastic spring is provided in the first enlarged cavity.

3. The combination putter and chipper golf club as set forth in claim 1, wherein the fastening member comprises a handle bolt which is fastened upwards from below the head, and the elastic spring is provided in the second enlarged cavity.

4. The combination putter and chipper golf club as set forth in claim 1, wherein a fastening hole is formed in a central portion of the coupling frame, the fastening member comprises a handle bolt which is fastened from a position above the fastening hole through the through hole of the head, and the elastic spring is provided in the second enlarged cavity, with a nut being fastened to a lower end of the handle bolt.

5. The combination putter and chipper golf club as set forth in claim 1, wherein an elastic member is interposed between the coupling frame and the head.

6. The combination putter and chipper golf club as set forth in claim 1, wherein the coupling frame comprises:
- a body;
- a shaft coupler provided on an upper portion of the body;
- a head coupler protruding from a lower portion of the body; and a positioning protrusion provided on each of opposite ends of the body in a longitudinal direction thereof.

7. The combination putter and chipper golf club as set forth in claim 6, wherein a positioning hole is formed in an upper portion of the head in such a way as to be located at a position corresponding to that of the positioning protrusion.

* * * * *